US012553293B2

(12) United States Patent
Yang et al.

(10) Patent No.: US 12,553,293 B2
(45) Date of Patent: Feb. 17, 2026

(54) PDC DRILL BIT WITH SWING SELF-ADAPTIVE CUSHION STRUCTURE

(71) Applicants: SOUTHWEST PETROLEUM UNIVERSITY, Sichuan (CN); CHENGDU WEIYI PETROLEUM TECHNOLOGY CO., LTD, Sichuan (CN)

(72) Inventors: Yingxin Yang, Sichuan (CN); Deng Zhang, Sichuan (CN); Chunliang Zhang, Sichuan (CN); Haitao Ren, Sichuan (CN); Shiwei Niu, Sichuan (CN); Yang Li, Sichuan (CN)

(73) Assignees: SOUTHWEST PETROLEUM UNIVERSITY, Sichuan (CN); CHENGDU WEIYI PETROLEUM TECHNOLOGY CO., LTD, Sichuan (CN)

( * ) Notice: Subject to any disclaimer, the term of this patent is extended or adjusted under 35 U.S.C. 154(b) by 50 days.

(21) Appl. No.: 18/557,212

(22) PCT Filed: Jan. 24, 2022

(86) PCT No.: PCT/CN2022/073452
§ 371 (c)(1),
(2) Date: Oct. 25, 2023

(87) PCT Pub. No.: WO2022/227732
PCT Pub. Date: Nov. 3, 2022

(65) Prior Publication Data

US 2024/0229563 A1 Jul. 11, 2024

(30) Foreign Application Priority Data

Apr. 30, 2021 (CN) ..... 202110486231.8
Jun. 25, 2021 (CN) ..... 202110710078.2

(51) Int. Cl.
*E21B 10/567* (2006.01)
*E21B 12/04* (2006.01)

(52) U.S. Cl.
CPC ..... *E21B 10/567* (2013.01); *E21B 12/04* (2013.01)

(58) Field of Classification Search
CPC ..... E21B 10/43; E21B 10/46; E21B 10/567; E21B 10/62; E21B 12/04
See application file for complete search history.

(56) References Cited

U.S. PATENT DOCUMENTS 5,560,440 A * 10/1996 Tibbitts ..... E21B 10/32 175/286
6,142,250 A * 11/2000 Griffin ..... E21B 44/005 175/426

(Continued)

FOREIGN PATENT DOCUMENTS

CH 689948 A5 2/2000
CN 109458137 A 3/2019

(Continued)

*Primary Examiner* — Nicole Coy
*Assistant Examiner* — Nicholas D Wlodarski
(74) *Attorney, Agent, or Firm* — NKL Law; Allen Xue

(57) ABSTRACT

A PDC drill bit has a drill bit body and a blade. The blade is provided with cutting teeth. At least one cushion structure is rotatably connected to the drill bit body. The cushion structure makes contact with bottom hole rock, and the cushion structure swings in a direction opposite to the cutting of the drill bit. Alternatively, a cushioning portion on the cushion structure is eccentrically arranged. Under the action of the normal force of the bottom hole rock, the cushioning portion swings to an offset side. The cushion structure is detached from the bottom hole rock and is reset towards a free state under the action of a reset mechanism. Under complex motion conditions such as compound drilling and drilling into hard or non-uniform stratum conditions, (Continued)

the swing of the cushion structure absorbs an impact load and avoids impact damage to the cutting teeth.

12 Claims, 17 Drawing Sheets

(56) References Cited

U.S. PATENT DOCUMENTS

| | | | | |
|---|---|---|---|---|
| 2014/0311801 | A1* | 10/2014 | Jain | E21B 17/1092<br>76/108.4 |
| 2021/0140239 | A1* | 5/2021 | Miess | E21B 4/02 |
| 2022/0162913 | A1* | 5/2022 | Zhang | E21B 12/00 |

FOREIGN PATENT DOCUMENTS

| | | | |
|---|---|---|---|
| CN | 110145238 | A | 8/2019 |
| CN | 110145240 | A | 8/2019 |
| CN | 110359856 | A | 10/2019 |
| CN | 113482540 | A | 10/2021 |
| CN | 215520781 | U | 1/2022 |

* cited by examiner

PDC DRILL BIT WITH SWING SELF-ADAPTIVE CUSHION STRUCTURE

TECHNICAL FIELD

The present invention belongs to the technical equipment field of oil and natural gas drilling engineering, mining engineering, construction foundation engineering drilling construction, geological drilling, geothermal drilling, hydrological drilling, tunnel engineering, shield tunneling and trenchless engineering, and in particular relates to a PDC drill bit with a swing self-adaptive cushion structure.

BACKGROUND

Rock breaking is the fundamental problem of drilling. Mechanical rock breaking is still the main operation method in oil and gas drilling at this stage. The drill bit is a rock breaking tool used to break the rock and form a wellbore. The drill bit plays an irreplaceable role in drilling engineering as the absolute main force. PDC drill bits are the most commonly used. The roller cone bit relies on the extrusion of the teeth on the bottom hole rock to generate lateral pressure, and the lateral pressure forms shear force. After the rock reaches the shear strength, it breaks and fails. In this process, the transmission and transformation of energy reduces its utilization rate. PDC drill bits are gradually replacing roller cone bits in soft to medium hard formations by virtue of their efficient shearing method. In particular, the rapid progress of cutting tooth material technology, basic theory of drill bits, and bit design technology has broadened the formation adaptability of PDC drill bits, and the proportion of PDC drill bits in the total footage of oil and gas drilling has increased from 5% in the 1880s. to 90%. Fixed cutter bits represented by PDC drill bits usually have several blades, and the blades are provided with a plurality of cutters along the radial direction of the bit (for PDC drill bits, the cutters are mainly polycrystalline diamond composite sheets, referred to as composite sheets for short or PDC teeth). According to data, the deep complex formation, which only accounts for 20% of the total footage, spends 80% of the total cost of the entire drilling cycle. Difficult-to-drill strata mainly refer to the poor drillability of the stratum, which is manifested by high rock hardness, high inhomogeneity, strong abrasiveness, and high temperature. These rock properties may have various complex combinations and changes, and are generally unpredictable, especially in the deep formations of deep and ultra-deep wells. The drill bit has a short drilling life in complex and difficult-to-drill formations, consumes more drill bits, and causes frequent trips and trips, which has become one of the technical bottlenecks restricting the cost reduction and efficiency increase of drilling engineering.

During the drilling process, the cutting teeth of the PDC drill bit overcome the ground stress and bit into the formation under the action of the WOB, and shear and break the formation material under the drive of torque. Compared with the rock breaking method of impact rolling of the roller cone bit, the required driving torque is larger. When drilling into deep and difficult-to-drill strata, especially when encountering soft and hard staggered, gravel-bearing strata, the depth of the drill bit biting into the stratum frequently changes, and the drill bit vibrates violently in the circumferential and axial directions. At this time, the cutting teeth of the drill bit are subjected to large circumferential and axial impact loads, resulting in chipping of the drill bit, damage, breakage of the drill tool, and damage to other downhole tools and measuring instruments, which seriously affects the drilling efficiency. In particular, the cutters in the outer third of the drill are more susceptible to damage due to the high linear velocity. When the cutting teeth of the PDC drill bit are worn, in order to maintain a certain ROP, the WOB is often increased, and the torque is particularly sensitive to the WOB. With the increase of the WOB, the torque increases, which makes the working condition of the drill bit worse, and the drill is thus more prone to failure. How to increase the working life of PDC drill bit in deep and difficult-to-drill formations and reduce the sensitivity of bit torque to WOB is an important technical problem to prolong the service life of downhole drilling tools and drill bits and improve drilling efficiency.

To this end, researchers in the field have begun to try to set a cushion structure on the drill bit, such as a diamond drill bit suitable for hard formation drilling (application number: 201810138571.X), which proposes to extend a buffer base in front of the blade, and provide a buffer element on the buffer base, which may effectively reduce the circumferential span and reduce the circumferential impact vibration when the drilling is complex and it is difficult to drill into the formations, thus reducing the axial impact and playing the role of protecting the PDC teeth. However, the buffer element in this patent is a fixed buffer element, and the relative height between the buffer element and the diamond teeth is a fixed value. The fixed buffer element has a narrow stratum adaptation range. For strata with complex and changeable lithology, especially for the drilling from hard strata into soft formations, the fixed buffer element will reduce the biting capacity of the diamond teeth and reduce the rate of penetration of the drill bit.

SUMMARY

The purpose of the present invention is to: provide a PDC drill bit with a swing adaptive cushion structure in view of the problems above, wherein the drill bit may use the yaw of the cushion structure according to the formation conditions to reduce the premature failure of the cutting teeth caused by vibration, thereby prolonging the working life of hard formation drilling.

The purpose of the present invention is achieved through the following technical solutions:

- a PDC drill bit with a swing-adaptive cushion structure, comprising a drill body and a blade extending from the drill body, wherein the blade is provided with cutting teeth, and at least one cushion structure is arranged on the drill bit; the cushion structure is rotatably connected to the drill bit body, and the cushion structure may swing relative to a rotating portion;
- when the cushion structure in the initial position is subjected to the impact from the formation rock, the same absorbs the impact load, so as to reduce the impact force of the cutting teeth, and act as a cushion for the cutting teeth;
- after that, under the action of the force in contact with the bottom hole rock, the cushion structure swings in the opposite direction to the cutting of the drill bit; or, the cushioning portion on the cushion structure is eccentrically arranged. Under the action of the normal force of the bottom hole rock, the cushioning portion makes a swing motion on the offset side to reduce or avoid the restriction of the cushion structure on the biting depth of the cutting teeth; and
- when the cushion structure is separated from the bottom hole rock or when the contact resistance torque is less than the reset torque, under the action of a reset mechanism, the same swings toward the initial position of the cushion structure to reset after the cushion structure relieves the impact, which plays a cushioning role for the subsequent impact of the cutting teeth.

The working principle of the drill bit of the present invention:

Under drilling conditions, due to complex force, drill string vibration, formation changes, etc., the biting depth of the cutting teeth into the formation changes frequently and the amplitude is large, which is easy to generate vibration, especially axial vibration. The cutting teeth (polycrystalline diamond compacts) on the drill bit suffer from shock damage under vibratory conditions, especially when drilling into hard or heterogeneous formations.

In particular, under the condition of compound drilling (refer to FIG. 3), since the screw has its own bending angle, there is a certain included angle & between the axis of rotation (rotation axis) of the drill bit and the axis (revolution axis) of a drill string, and the centers of the rotation of the drill bit (@2, provided by a screw motor) and revolution (@1, provided by a turntable) are no longer coincident, the vector sum of the two motion speeds is no longer directly superimposed, and the motion of the drill is more complicated. During the composite drilling process of steerable drilling, the actual wellbore diameter is larger than the drill bit diameter due to the deviation between the axis of rotation of the drill bit and the axis of the drill string (or well wall). In this case, in the radial range, only part of the blade of the drill bit actually contacts the unbroken rock, and there is an obvious "lifting" phenomenon. In the dynamic rock breaking process, under the action of revolution and rotation, the interaction between the drill bit and the rock is actually a drilling and milling process. For the PDC drill bit, a plurality of blades are arranged on the drill bit body (see FIG. 2), and there is a certain span L in the circumferential direction between the blades. The blades are in contact with the rock in turn, and the two blades impact the bottom or wall rocks during switching.

In the solution above, by arranging a swingable cushion structure on the drill bit, the cushion structure may realize reciprocating swing within a certain design angle under the action of the external force and the reset mechanism, so that the cushioning portion of the cushion structure may be higher than, equal to or lower than the drill bit. Therefore, the self-adaptation of the cutting depth of the drill cutting teeth may be achieved, and the vibration reduction effect may be achieved. Referring to FIG. 4 and FIG. 29, the working process of the cushion structure is divided into three stages: first, the initial stage when the blade is impacted. When the drill bit is impacted, the cushioning portion is at the initial position and starts to rotate to a low position at the initial stage (the height of the cushioning portion drops less), and in this stage, the contact area between the cushioning portion and the bottom hole rock is large, so that the cushioning portion may perform a better cushion role. The second is the stage of sharp reduction of the cushion effect (or the effect of limiting biting depth). In this stage, the swing motion is made in the opposite direction of the bit cutting, or the cushioning portion on the cushion structure is eccentrically arranged (see FIG. 29). Under the action of the normal force of the bottom hole rock, the cushioning portion makes a swinging motion on the offset side, the restriction on the biting depth of the cutting teeth begins to weaken until it reaches the lowest position (at this time, the effect of limiting biting depth is the weakest, the cutting teeth on the blade are in the stable cutting stage, and the biting teeth of the drill bit into the rock and drill normally, the cutting depth of the bit cutter gradually deepens, the bit gradually increases the cutting capacity, and the drill bit may obtain a faster ROP); finally, when the blade is separated from the bottom hole rock, or the contact resistance moment between the cushioning portion and the rock is smaller than the reset torque, the cushioning portion is quickly reset under the action of the reset mechanism, so that the cushioning portion is in the initial position, so as to avoid the situation that the cutting depth of the cutting teeth of the drill bit is instantaneously excessive, and then the cushion structure continues to swing. In this way, the self-adaptive adjustment of the cutting depth of the cutting teeth of the drill bit is realized.

In the solution above, the swinging direction of the cushion structure is opposite to the cutting direction of the drill bit, which is easily understood by those skilled in the art, and is only briefly described here.

Referring to FIG. 26, based on the installation or design reference point of the cushion structure (referred to as There), the vertical line TC of the line OT connecting the reference point and the center of the drill bit is the cutting direction of the drill bit at this point, and the swing direction TD of the cushion structure is at the right side of the current view line OT, that is the opposite direction of the drill bit cutting. TC' is denoted as the forward and reverse cutting direction, and the swing direction TD of the cushion structure and TC' have a certain included angle $\alpha$. When the included angle $\alpha$ is 0°, it is consistent with the opposite direction of the drill bit cutting (i.e., the cutting is forward and reverse); and when the included angle $\alpha$ is 90° or −90°, it is the perpendicular direction to the drill bit cutting direction. Therefore, the swinging direction of the cushion structure is opposite to the cutting direction of the drill bit, which may also be understood as the direction of all angles except the vertical direction, that is, in the current view, all angles to the right of the line OT are comprised. Obviously, in this swing mode, the cushioning portion is located on the bottom hole normal line through the swing center or slightly deviated, with both normal and tangential forces when in contact with the rock. However, the driving force of the swing in the opposite direction of the drill bit cutting is the tangential force of the bottom hole rock on the cushioning portion.

The eccentric arrangement of the cushioning portion refers to the position of the cushioning portion offset from the bottom hole normal passing through the swing center, as shown in FIG. 28 or 29. When the cushioning portion is eccentrically arranged, this cushion structure may be called an offset cushion structure. When the cushioning portion is located on the bottom hole normal line (the normal line of the bottom hole rock) passing through the swing center, the non-eccentric setting is shown in FIG. 5. The cushioning portion is offset relative to the bottom hole normal line passing through the swing center, and the offset is large. Therefore, when the cushioning portion touches the bottom hole, the force from the bottom hole rock has both normal force and tangential force. No matter which direction the cushion structure is placed in, the normal force will make the cushioning portion swing around its rotation axis (i.e., the rotating portion) on the offset side. The larger the offset, the greater the torque that drives the cushioning portion to swing (because of the longer moment arm of the normal force).

The tangential force cannot effectively drive the swing of the cushion in all placement directions, especially when the swing is perpendicular to the cutting direction of the drill bit, the tangential force cannot produce the moment that makes the cushion swing. However, because of the eccentric arrangement of the cushioning portion, the normal force may generate the moment of its swing. However, in the offset scheme, the swing process of the cushion structure mainly depends on the normal force from the bottom hole rock on the cushion structure. It may be seen from the description above that when the cushion structure utilizes this swinging manner, the installation position thereof is not limited.

Preferably, the cushion structure is arranged on the blade and is rotatably connected to the blade.

In the solution above, the blade is extended from the bit body and is a part of the drill bit body. Setting the cushion structure on the blade may save valuable space of the drill bit; secondly, setting the blade closer to the cutting teeth has a better cushioning effect.

Preferably, when the cushion structure is in the initial position, the height difference D between the highest point of the cushion structure for contacting the bottom hole rock surface and the highest point of the cutting tooth edge is: $-d \leq D \leq d$, where d is the diameter of the cutting teeth.

Preferably, the cushion structure is arranged in front of and/or behind the cutting teeth, or the cushion structure is arranged on an independent support of the blade or the drill bit body.

Preferably, the cushion structure is arranged behind the cutting teeth on the same blade, and the swing direction of the cushion structure has a certain included angle with the opposite cutting direction of the drill bit at the same position, and the included angle ranges from −90° to 90°.

Preferably, the swing direction of the cushion structure and the movement direction of the drill bit at the same position have a certain included angle, and the included angle ranges from −45° to 45°.

In the solution above, the movement direction of the drill bit actually refers to the cutting direction thereof.

Preferably, the swing direction of the cushion structure and the movement direction of the drill bit at the same position have a certain included angle, and the included angle ranges from −20° to 20°.

Preferably, the swing direction of the cushion structure is consistent with the movement direction of the drill bit at the same position.

Preferably, the cushion structure is arranged behind the cutting teeth on the same blade, and the swing direction of the cushion structure is consistent with the movement direction of the drill bit at the same position.

Preferably, the cushion structure comprises a swing portion and a cushioning portion, the swing portion is rotatably installed in the base hole of the blade, the cushioning portion is connected to the swing portion, and is connected to the swing portion after the cushioning portion is stressed. The rotating portion performs synchronous swinging action, and the swinging part is connected to the reset mechanism arranged in the base hole, so that the swinging part may be automatically reset when the external force is swung and the external force is reduced or disappeared.

Preferably, the cushioning portion is an insert tooth structure that is embedded and fixed on the swing portion, or the cushioning portion is a rolling structure that is rotatably connected to the swing portion, or the cushioning portion and the swing portion are all-in-one structure.

Preferably, the swing portion is a runner structure or a swing rod structure.

In the solution above, the runner has a simple structure, high reliability, and is easy to install. The swing rod structure occupies a small width space and has a larger design space.

Preferably, the cushioning portion 411 is eccentrically arranged relative to the swing portion 41 toward the swing direction thereof.

In the solution above, especially when the swing direction of the cushion structure has a certain included angle a with the reverse cutting direction of the drill bit, the eccentric setting effect of the cushioning portion is better. Further, especially, the swing direction of the cushion structure is radial when the direction of the cushion is set off-center, the effect is the best.

Preferably, the reset mechanism is an elastic reset mechanism and/or a hydraulic reset mechanism.

In the solution above, the elastic reset mechanism is adopted, which has a simple structure and stable and reliable reset. The hydraulic reset mechanism may provide sufficient reset force and has strong reset ability. The combination of elastic and hydraulic reset may provide greater reset force, so as to further improve the speed of the swing reset of the cushion structure.

Preferably, the elastic reset mechanism is a spring, a disc spring, a torsion spring, a coil spring, a leaf spring or rubber.

Preferably, the cushion structure is applied to a composite drill bit in which the PDC cutting structure is combined with other cutting structures.

In the solution above, the composite drill bit comprises a PDC-roller cone composite drill bit, an impact scraping and cutting composite bit, and a cross scraping and cutting composite bit. The composite drill bits usually contain movable cutting structures or rock-breaking structures, which generate certain vibrations during the drilling process. Therefore, setting the swing-adaptive cushion structure on the compound drill bit is beneficial to protect the cutting teeth on the fixed cutting structure.

Preferably, the cushion structure is provided with a secondary cushioning portion.

Compared with the prior art, the beneficial effects of the present invention are:

1. The reset mechanism is a solution of a reset spring, with a simple structure, easy design, installation and application.
2. The swing direction of the swing structure is matched with the cutting direction of the cutting teeth, which may provide continuous and effective inner swing (opposite to the cutting direction of the cutting teeth, and vice versa, outer swing) power. When drilling in soft ground or homogeneous ground, the cushioning portion of the cushion structure may stably swing to a position lower than the cutting teeth, without affecting the rock breaking efficiency of the drill bit.
3. When drilling into hard strata or inhomogeneous strata under impact load, the existence of the reset mechanism may greatly reduce the inward swing speed of the cushion structure, so as to achieve the effect of absorbing the impact load, avoid the damage of the cutting teeth caused by the impact, and prolong the working life of the drill bit.
4. During a sliding guide drilling process, because of the existence of the cushion structure, the working torque of the drill bit may be reduced to a certain extent, and the adjustment efficiency of the tool face may be improved.
5. In the solution of setting the swing adaptive cushion structure into a module, the design freedom of the drill bit may be increased, and the installation and repairing may be facilitated at the same time.

6. It is beneficial to reduce the torque fluctuation of the drill bit and reduce the stick-slip vibration tendency of the drill bit.
7. In the solution of offsetting the cushioning portion, the cushioning portion is subjected to normal force to contract and swing inwards during operation. Therefore, the installation of the cushion structure may not be restricted by the angle, and the design freedom is higher.

BRIEF DESCRIPTION OF THE DRAWINGS

The present invention will be described by way of specific embodiments with reference to the accompanying drawings, wherein

FIG. 25 is a drawing of the covered teeth of the drill bit structure of the present invention, wherein.

FIG. 26 is a schematic structural diagram of Embodiment 10 of the present invention, wherein the included angle between the swinging direction of the cushion structure and the cutting direction of the cutting teeth is $\alpha$.

FIG. 27 is a schematic structural diagram of Embodiment 10 of the present invention, wherein the included angle between the swinging direction of the cushion structure and the cutting direction of the cutting teeth is 90° or −90°.

Figure 1:
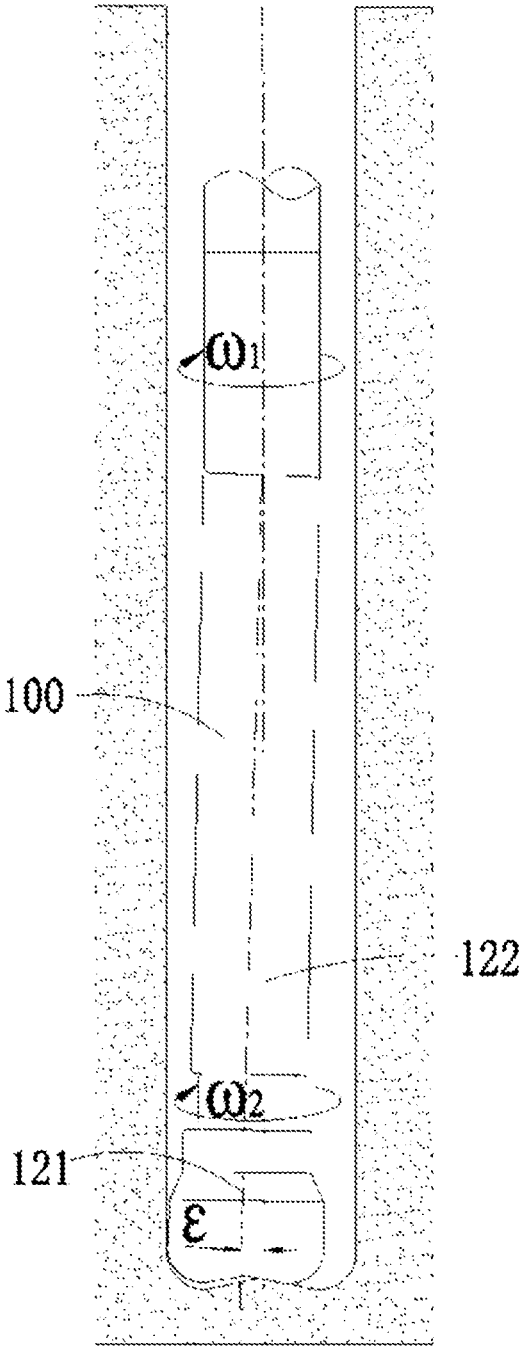
FIG. 1 is a schematic diagram of the working principle of a drill bit during compound drilling.

The corresponding names are marked in the FIGURE: 1 is the drill bit body, 2 is the blade, 21 is the base hole, 3 is the cutting tooth, 31 is the cutting direction of the cutting tooth, 4 is the cushion structure, 11 is the bottom hole normal line, 51 is the swing direction of the cushion structure, 41 is the swing portion, 42 is the reset mechanism, 43 is the base, 48 is the rotating portion, 401 is the leaf spring, 402 is the rubber, 411 is the cushioning portion, 400 is the rigid block, 412 is the runner, 413 is the swing rod, 415 is the secondary cushioning portion, 418 is the limit groove, 4120 is the first bottom contact surface, 421 is the hydraulic reset mechanism, 422 is the transmission device, 481 is the swing center, 5 is the torsion spring, 6 is the disc spring, 7 is coil spring, 8 is the linear spring, 81 is the push rod, 82 is the sealing ring, 85 is the roller, 91 is the first check valve, 92 is the second check valve, 96 is the intermediate valve seat, 97 is the reset piston, 100 is the screw, 101 is the first chamber, 102 is the second chamber, 103 is the middle chamber, 10 is the limit pin, 20 is the support, 121 is the axis of rotation of the drill bit, 122 is the axis of the drill string, and 4111 is the cushion tooth.

DETAILED DESCRIPTION OF THE PREFERRED EMBODIMENTS

The technical solutions of the embodiments of the present invention will be described clearly and completely as follows in combination with the figures of these embodiments for a clear understanding of the purposes, technical solutions and advantages of the present invention. Apparently, the embodiments described are only some, not all of the embodiments of the present invention. Generally, the components in the embodiments of the present invention described and shown in the figures herein may be arranged and designed in various configurations.

Therefore, the detailed descriptions of the embodiments of the present invention provided in the figures are not intended to limit the scope of the present invention, and the embodiments are only certain embodiments of the present invention. Based on the embodiments of the present invention, other embodiments acquired by those of ordinary skill in the art without creative work also belong to the protection scope of the present invention.

It should be noted that the features in the embodiments and the embodiments of the present invention may be combined with each other in a non-conflicting situation.

It should be noted that similar marks and letters generally indicate similar items. Therefore, any item already defined in one figure is not necessarily further defined and explained in the subsequent figures.

For description of the embodiments in the present application, it should be noted that orientation or position relations indicated are based on the orientation or position relations shown in the figures or the commonly arranged orientation or position relations as used in the applied product, or the orientation or position relations commonly understood by those skilled in the art or the orientation or position relations commonly placed when the applied product is used, and they are used to describe the present application and simplify description herein instead of indicating or implying that the equipment or component indicated must have specific orientation and be constructed and operated in specific orientation. Therefore, the embodiments described herein shall not be construed as limitation hereto. In addition, the terms "first" and "second" are only used to distinguish descriptions instead of being construed as indication or implication of relative importance.

In the description of the embodiments of present invention, it should be also noted that unless otherwise explicitly specified and defined, the terms "arrangement" and "connection" are to be understood in a broad sense, for example, a fixed connection, a removable connection, or an integral connection, or understood as directly connected or indirectly connected through an intermediate.

Those of ordinary skill in the art may understand the specific meanings of these terms in the present invention according to actual conditions. The technical solutions contained in the embodiments of the present invention are described in detail clearly and completely hereinafter with references to the accompanying drawings for the embodiments of the present invention. Apparently, the described embodiments are only a portion of embodiments of the present invention, but not all the embodiments of the present invention. Generally, the components in the embodiments of the present invention described and shown in the figures herein may be arranged and designed in various configurations.

Embodiment 1

The present invention provides a PDC drill bit with a swing-adaptive cushion structure, comprising a drill bit body 1 and a blade 2 extending from the drill bit body 1, wherein the blade 2 is provided with cutting teeth 3, and at least one cushion structure 4 is arranged on the drill bit; the cushion structure 4 is rotatably connected to the drill bit body 1, and the cushion structure 4 may swing relative to a rotating portion (the rotating portion may be a shaft or a shaft hole, the cushion structure is rotationally connected to the drill bit body through the shaft or the shaft hole) 48; when the cushion structure 4 in the initial position is subjected to the impact from the formation rock, the same absorbs the impact load, so as to reduce the impact force of the cutting teeth 3, and act as a cushion for the cutting teeth 3; then, the cushion structure (4) swings toward the opposite side of the drill bit under the force of contact with bottom hole rock, so as to reduce or prevent the cushion structure (4) from limiting the biting depth of the cutting teeth (3); and the cushion structure 4 is separated from the bottom hole rock, and under the action of the reset mechanism 42, the same swings toward the initial position of the cushion structure to reset after the cushion structure relieves the impact, which plays a cushioning role for the subsequent impact of the cutting teeth 3.

Wherein, the cutting teeth 3 refer to the cutting elements that break the rock by scraping and shearing, mainly comprising PDC teeth (polycrystalline diamond composite sheet), TSP teeth (thermally stable diamond polycrystalline sheet), axe ridge teeth, with micro-cutting function impregnated horizontal teeth and other diamond cutters with non-planar surfaces. The material of the cutting teeth may also be synthetic diamond, natural diamond, impregnated diamond, cemented carbide, cubic boron nitride, ceramics and the like. The cushioning portion of the cushion structure refers to the components that mainly bear the impact load, such as spherical teeth, conical teeth, wedge teeth, etc. The materials may be artificial diamond, natural diamond, impregnated diamond, cemented carbide, cubic nitrogen Boron, ceramics, etc.

Figure 2:
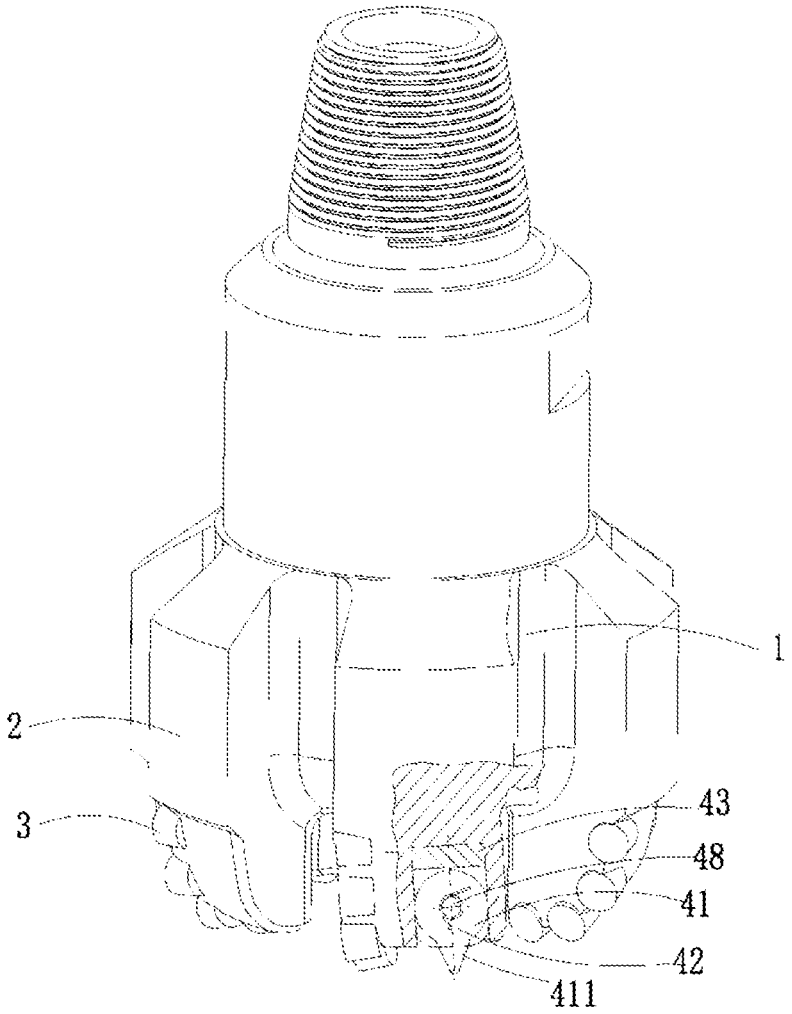
FIG. 2 is a schematic structural diagram of Embodiment 1 of the present invention.
Figure 3:
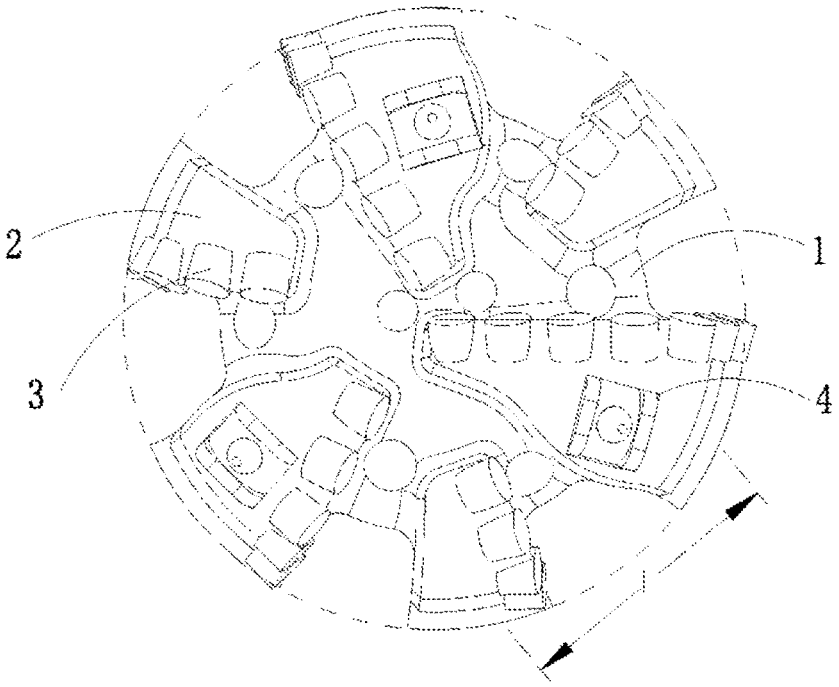
FIG. 3 is a top view of FIG. 1.
Figure 4:
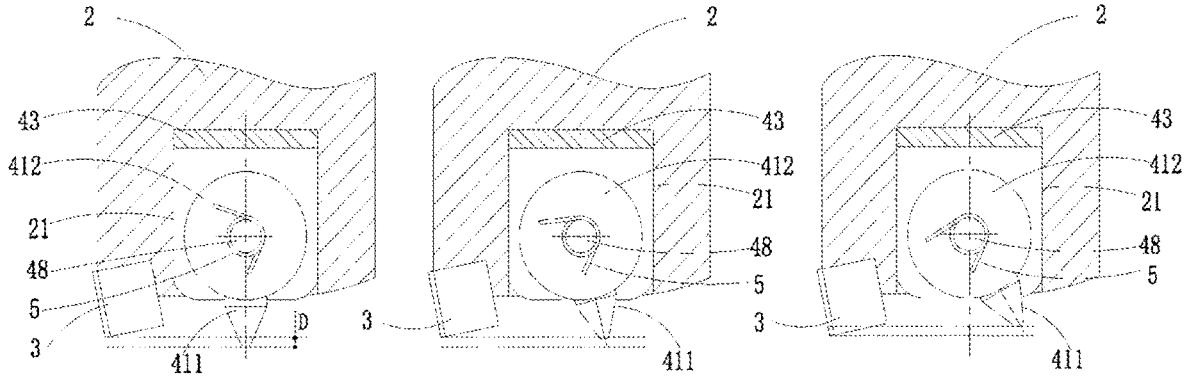
FIG. 4 is a schematic diagram of a swing and a working principle diagram of the cushion structure in the present invention.

FIGS. 2 to 4 are schematic structural diagrams of a drill bit provided by an embodiment of the present invention. Specifically, a base hole 21 is formed in the blade 2, and a swing adaptive cushion structure 4 is installed in the base hole 21. The cushion structure 4 comprises a swing portion 41 and a cushioning portion 411. The swing portion 41 is rotatably installed in the base hole 21 of the blade 2. The cushioning portion 411 is connected to the swing portion 41 and synchronously swings with the swing portion 41 after the cushioning portion 411 is stressed. The swing portion 41 is connected to a reset mechanism 42 arranged in the base hole 21, so that the swing portion 41 may be automatically reset after the external force is swung and when the external force decreases or disappears.

In the present embodiment, the swing portion 41 is a runner 412, the reset mechanism 42 is a torsion spring 5, and the cushion structure 4 is arranged behind the cutting teeth 3 on the same blade 2, and the cushion structure may realize reciprocating swing within a certain design angle under the action of the external force and the reset mechanism 42, so that the cushioning portion 411 may be higher or lower than the cutting teeth 3 of the drill bit. Therefore, the self-adaptation of the cutting depth of the drill cutting teeth 3 may be achieved, and the vibration reduction effect may be achieved.

In the case of hard strata, soft and hard interlayer, composite drilling of steerable drilling or other complex motions, the working process of the cushion structure 4 is divided into three stages: the first is the cushion stage of the cushion structure 4. When the drill bit is impacted, the cushioning portion 411 is at the initial position (free state) and starts to rotate to a low position at the initial stage (the height of the cushioning portion drops less), and in this stage, the contact area between the cushioning portion 411 and the bottom hole rock is large, so that the cushioning portion may perform a better cushion role. Secondly, it is the stage of sharp reduction of the cushioning effect (or the limiting penetration effect). In this stage, the cushioning portion 411 makes a swinging motion toward the direction opposite to the cutting direction, the restriction on the biting depth of the cutting teeth begins to weaken until it reaches the lowest position (at this time, the effect of limiting biting depth is the weakest, the cutting teeth 3 on the blade are in the stable cutting stage, and the cutting teeth of the drill bit are biting into the rock and drill normally, the cutting depth of the bit cutter gradually deepens, the bit gradually increases the cutting capacity, and the drill bit may obtain a faster ROP). Finally, when the cutting teeth 3 are separated from the bottom hole rock, the cutting depth of the blade cutting teeth 3 gradually moves in the direction of being out of contact with bottom hole. At this time, the cushioning portion 411 is quickly reset under the action of the reset mechanism 42, so that the cushioning portion 411 is in the initial position, so as to avoid the situation that the cutting depth of the cutting teeth 3 of the drill bit is instantaneously excessive, and then the cushion structure 4 continues to swing. In this way, the cutting depth of the cutting teeth 3 of the drill bit is adjusted in a self-adaptive manner.

Referring to FIG. 3, when the drill bit is stably drilling in soft strata or homogeneous strata, the swing portion 41 continues to swing inward to the position where the cushioning portion 411 is lower than the bit cutting teeth 3, and the cutting teeth of the drill bit are biting into the rock and drilling normally, the cutting depth of the bit cutter gradually deepens, the bit gradually increases the cutting capacity, and the drill bit may obtain a faster ROP. When the drilling encounters uneven or hard formations and is subjected to shock and vibration, at the moment of "jumping the drill", the swinging portion 41 quickly swings out to the initial position under the action of the reset mechanism 42, so that the cushioning portion 411 is higher than the cutting teeth 3 of the drill bit. It has the effect of absorbing vibration, and then the swing portion swings inward slowly, and in this way, the self-adaptive adjustment of the cutting depth of the cutting teeth 3 of the drill bit is realized.

As shown in FIG. 4, when the drill bit as a whole is not in contact with the rock, the position where the cushion structure is located is called the initial position. When the cushion structure 4 is in the initial position, the cushion structure 4 is used for the highest contact with the bottom hole rock surface. The height difference D between the highest point of the cushion structure 4 for contacting the bottom hole rock surface and the highest point of the cutting tooth 3 edge is: $-d \leq D \leq d$, where d is the diameter of the cutting teeth 3.

In the solution above, a solution that is easier to implement is that the height difference D between the highest point of the cushioning portion of the cushion structure and the highest point of the cutting tooth edge is: $-d/4 \leq D \leq d/4$.

Figure 5:
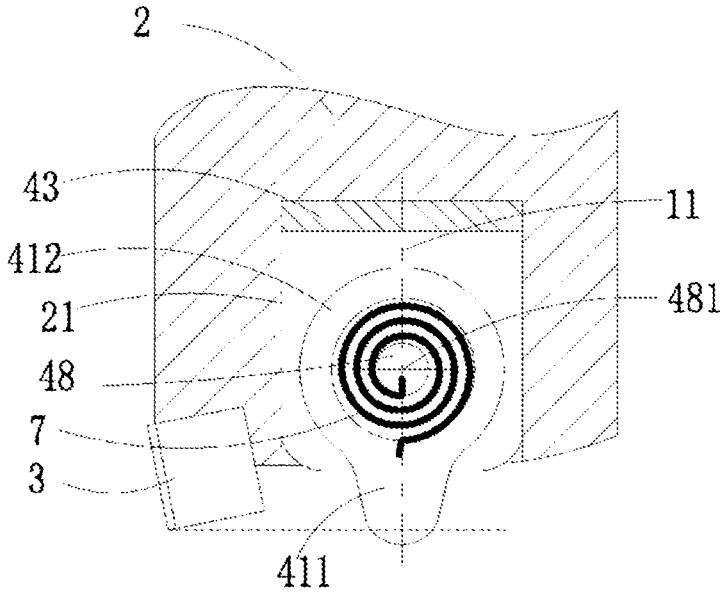
FIG. 5 is a schematic structural diagram of a coil spring used for the reset mechanism in Embodiment 1 of the present invention.

As another structure, as shown in FIG. 5, the reset mechanism 42 is a coil spring 7, which has a simple structure and is easy to implement.

Embodiment 2

The present embodiment is basically the same as Embodiment 1, and the main difference is that the reset mechanism is a hydraulic reset structure.

Figure 6:
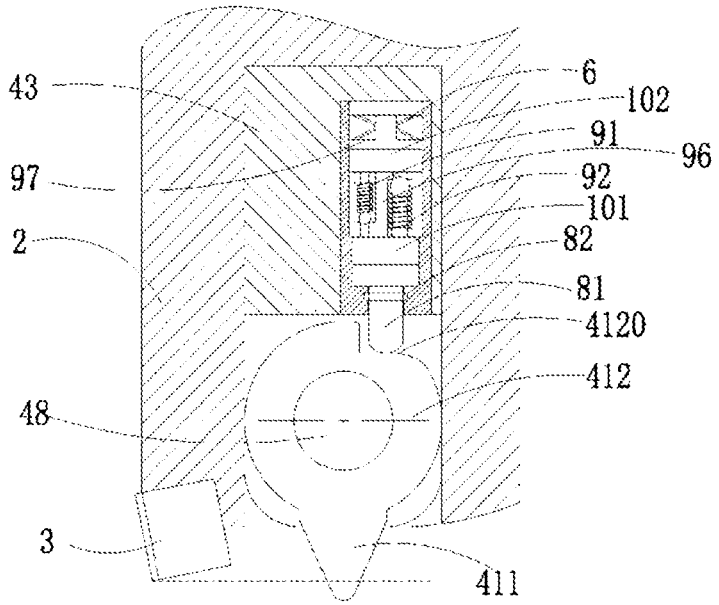
FIG. 6 is a schematic structural diagram of Embodiment 2 of the present invention, wherein the reset mechanism is a hydraulic reset structure.

As shown in FIG. 6, the reset mechanism 42 comprises a push rod 81, a first chamber 101, a second chamber 102, an intermediate valve seat 96, a first check valve 91, a second check valve 92, a disc spring 6, a sealing ring 82 and a reset piston 97. When a runner 412 swings inward, a first bottom contact surface 4120 pushes the push rod 81 to compress hydraulic oil in the first chamber 101 and flows into the second chamber 102 through the first check valve 91 with a small diameter, and the hydraulic oil in the second chamber 102 pushes the reset piston 97 to move a compression disc spring 6, at which time, the inner swing speed is small. During reset, the disc spring releases energy and pushes the reset piston 97 to compress the hydraulic oil in the second chamber 102, so that the same passes through the second check valve 102 with a large diameter and quickly enters the first chamber 91, and the push rod pushes the runner 412 to reset quickly.

The hydraulic reset structure of the present embodiment may provide a stable reset force and is highly reliable.

Figure 7:
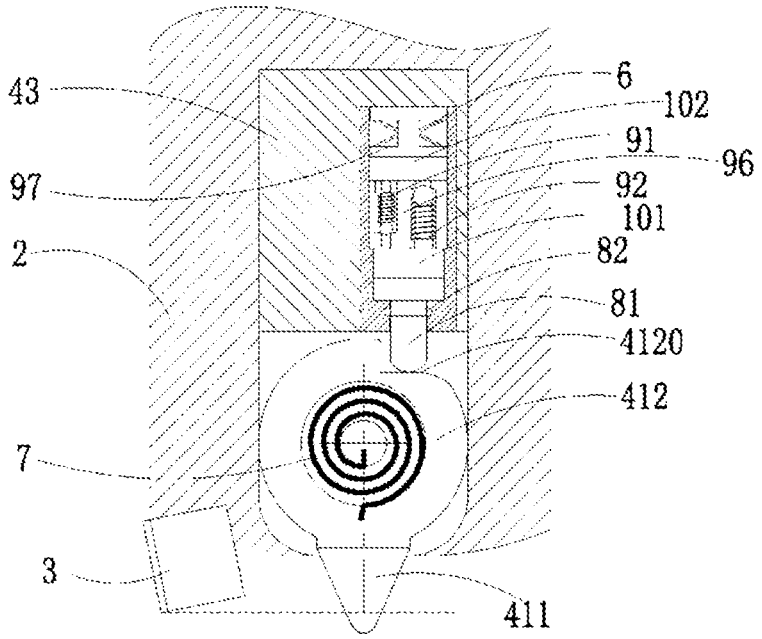
FIG. 7 is a schematic diagram of a combined structure of a coil spring and a hydraulic pressure as the reset mechanism in Embodiment 2 of the present invention.

In the structure above, a better solution is to further provide a torsion spring 5 or a coil spring 7 on the runner 412, which may output reset force more effectively and stably together with the hydraulic reset structure, wherein the FIG. 7 illustrates a solution that a coil spring 7 is provided on the runner 412.

Figure 8:
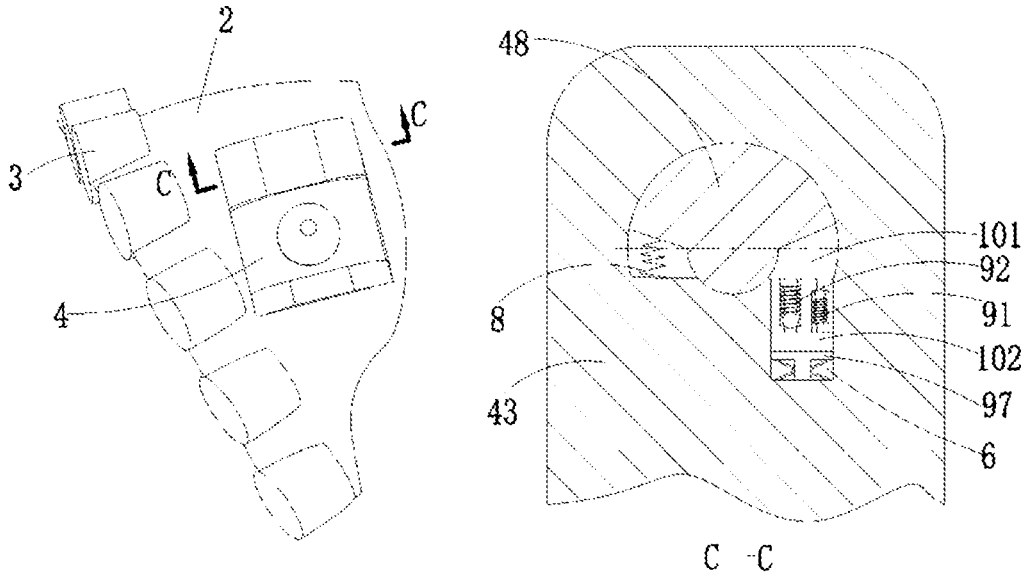
FIG. 8 is a schematic diagram of the reset mechanism in Embodiment 2 of the present invention being a torsional hydraulic reset mechanism.

The setting of the hydraulic reset mechanism also comprises another way, that is, a twist-type hydraulic reset mechanism, as shown in FIG. 8. A cavity is provided between a base 43 of the cushion structure 4 and the rotating portion 48 (rotating shaft), as the first chamber 101 of the hydraulic reset mechanism. When the rotating portion 48 rotates in the opposite direction of the drill bit movement (rotation to the right in the current view), that is, the cushion structure is in a working stage, the hydraulic oil in the first chamber 101 is squeezed by the rotating portion 48 to flow into the second chamber 102 through the first check valve 91 with a small diameter, and the hydraulic oil in the second chamber 102 pushes a reset piston 97 to move the compression disc spring 6. At this time, swing speed is small, which plays an obvious cushioning role. During reset, the disc spring 6 releases energy and pushes the reset piston 97 to compress the hydraulic oil in the second chamber 102, so that the oil enters the first chamber 91 quickly through the second check valve 102 with a large diameter, and the push rod pushes the runner 412 to reset quickly. The reset spring may also comprise a linear spring 8, rubber or the like.

Further, a plurality of cavities may be provided between the rotating portion 48 and the base 43, and a hydraulic reset mechanism or a mechanical reset mechanism (e.g., rubber, spring) may be provided according to the application. Referring to FIG. 8, two chambers are provided between the rotating portion 48 and the base 43, one of which is provided with a hydraulic reset mechanism, and the other chamber is provided with a mechanical reset mechanism (spring).

Embodiment 3

The present embodiment is basically the same as Embodiment 1, and the main difference is that the swing portion 41 is a swing rod structure.

Figure 9:
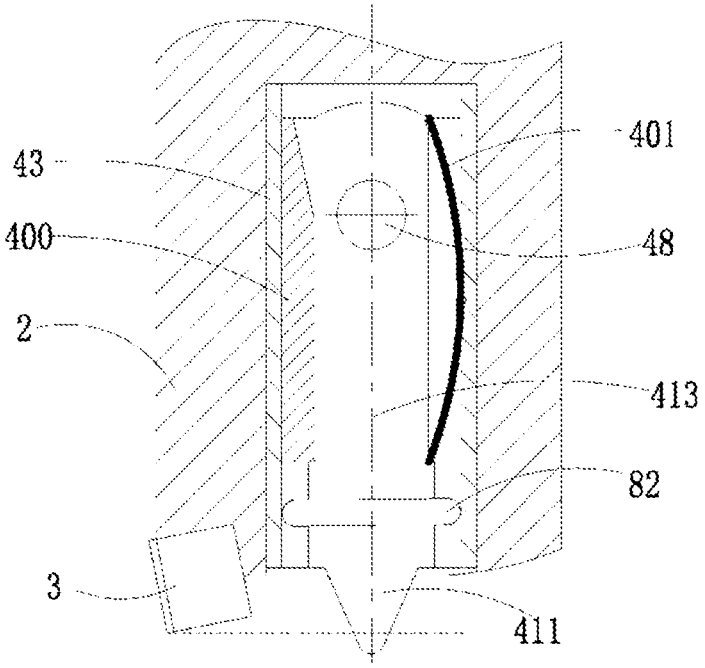
FIG. 9 is a schematic structural diagram of Embodiment 3 of the present invention, wherein the swing portion is a swing rod, and the reset mechanism is a leaf spring.
Figure 10:
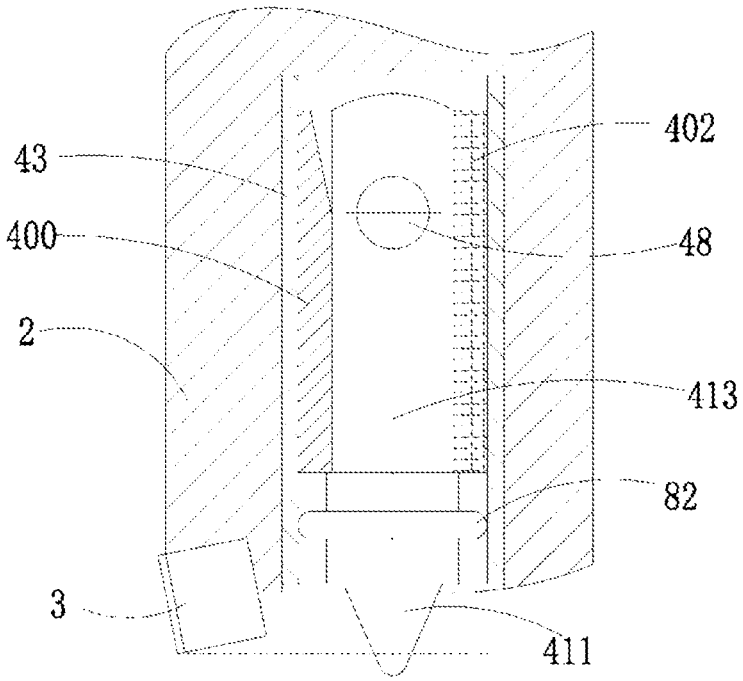
FIG. 10 is a schematic diagram of the structure in which the reset mechanism is rubber in Embodiment 3 of the present invention.

As shown in FIGS. 9 and 10, the swing rod 413 is rotatably connected to the base 43 through a pin shaft 10, and an elastic reset device is provided on a side of an inner swing (opposite to the cutting direction), and the elastic reset device is a leaf spring 401, as shown in FIG. 9. The device may also be rubber 402, as shown in FIG. 10. An outer swing (same as the cutting direction) is limited by a rigid block 400.

Further, the base 43 may be the blade 2 itself, or the base 43 may be fixedly connected to the blade 2, and the connection method may comprise hard fitting, welding, or integral molding.

Embodiment 4

The present embodiment is basically the same as Embodiment 3, and the main difference is that the reset mechanism is a hydraulic reset structure.

Figure 11:
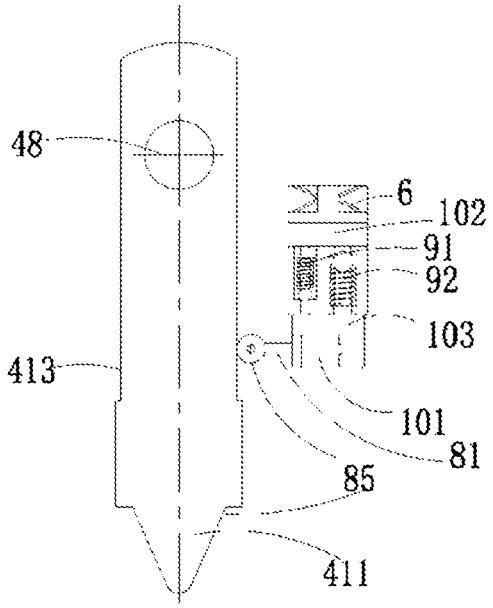
FIG. 11 is a schematic structural diagram of Embodiment 4 of the present invention, wherein the swing portion is a swing rod, and the reset mechanism is a hydraulic reset structure.

As shown in FIG. 11, the hydraulic reset structure is arranged on one side of the swing rod 413, and the hydraulic reset structure is slightly different from the structure in Embodiment 2. Specifically, the push rod 81 is arranged laterally and is in contact with the swing rod 413. A roller 85 is provided at one end of the shaft, which may effectively reduce the frictional resistance when the push rod 413 swings. A middle chamber 103 is formed in the reset mechanism 42 so as to move the push rod 81 horizontally.

Obviously, those skilled in the art may easily think that the position of the hydraulic reset structure is not limited to being arranged on the inner swing side of the swing rod, but may also be arranged at other positions, such as on the drill bit body, and the blade by means of appropriate structural deformation. Alternatively, other accommodating mechanisms may be added.

Embodiment 5

The present embodiment is basically the same as Embodiments 1 to 4, and the main difference is that the cushioning portion 411 is a cushioning tooth 4111, which is inlaid and fixed on a swing portion 41. Generally speaking, a working end of the cushion teeth is required to have high pressure resistance and impact resistance, such as the "blunt" cone-shaped teeth and wedge-shaped teeth used in roller cone bits. In addition, other components with pressure resistance and impact resistance may also be used as cushion elements, such as impregnated blocks and impregnated teeth. Curved surface of the working end of the cushion element may be flat, convex, concave, and combinations thereof. The material of the cushion element may be synthetic diamond, natural diamond, impregnated diamond, cemented carbide, cubic boron nitride, ceramics and the like.

Figure 12:
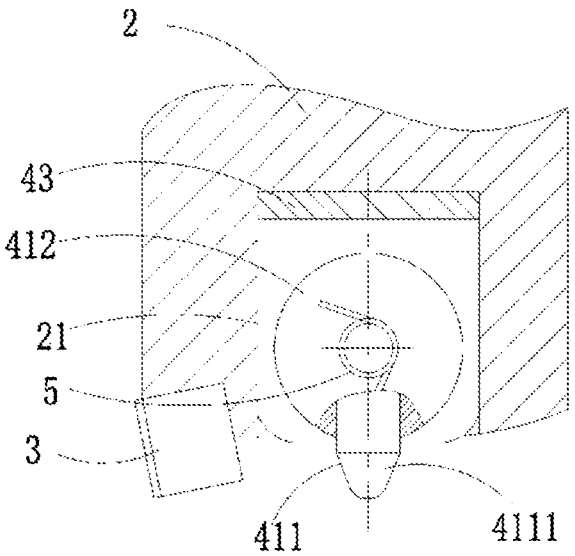
FIGS. 12 and 13 are schematic structural diagrams of Embodiment 5 of the present invention, wherein the cushioning portion is a cushion tooth.

As shown in FIG. 12, the cushion teeth 4111 and the runner 412 or the swing rod 413 of the cushion structure 4 are not integrally formed, but are installed by interference fit. Obviously, the cushion teeth 4111 may also be connected to the runner 412 or the swing rod 413 by means of welding or threading.

Figure 13:
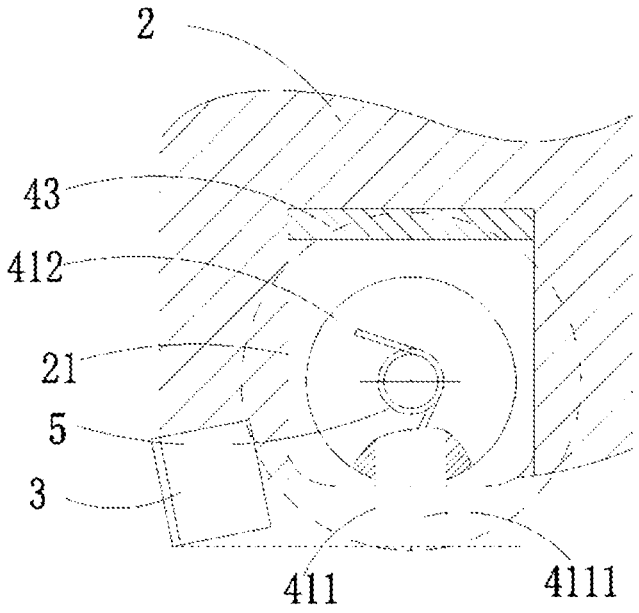

Further, as shown in FIG. 13, a working end (that is, a working surface in contact with the formation) of the cushion tooth 4111 is in the shape of an arc. A better solution is that the center of rotation of the arc of the working end of the cushion tooth is the rotation center of the swing portion 41. In this way, when the cushion tooth rotates in the initial stage, the cushion tooth may maintain a longer contact time with the bottom hole rock, so as to achieve a better cushion effect.

Figure 14:
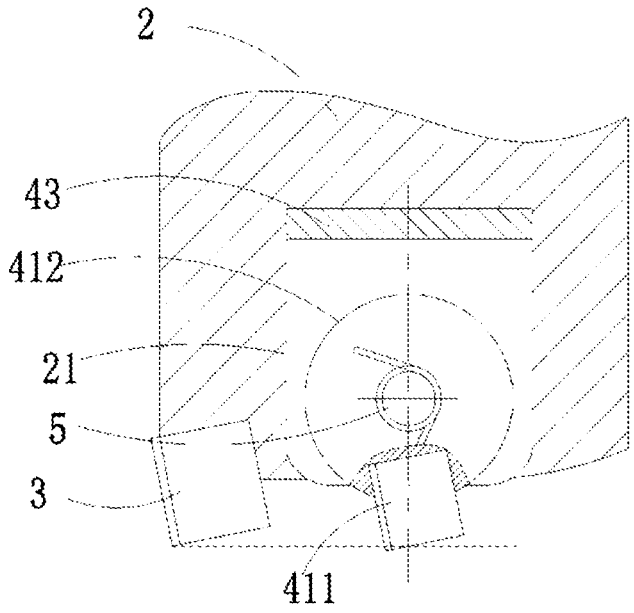
FIG. 14 is a schematic structural diagram of Embodiment 5 of the present invention, wherein the cushioning portion is a diamond compact.

Further, as shown in FIG. 14, the cushioning portion 411 may be a diamond compact, TSP cutting teeth, impregnated cutting teeth, or the like.

Embodiment 6

The present embodiment is basically the same as Embodiments 1 to 5. The main difference is that a swing adaptive cushion structure 4 may not only be arranged behind the cutting teeth 3, but also may be arranged in front of the cutting teeth 3, and may also be arranged at the front and rear of the cutting teeth 3.

Figure 15:
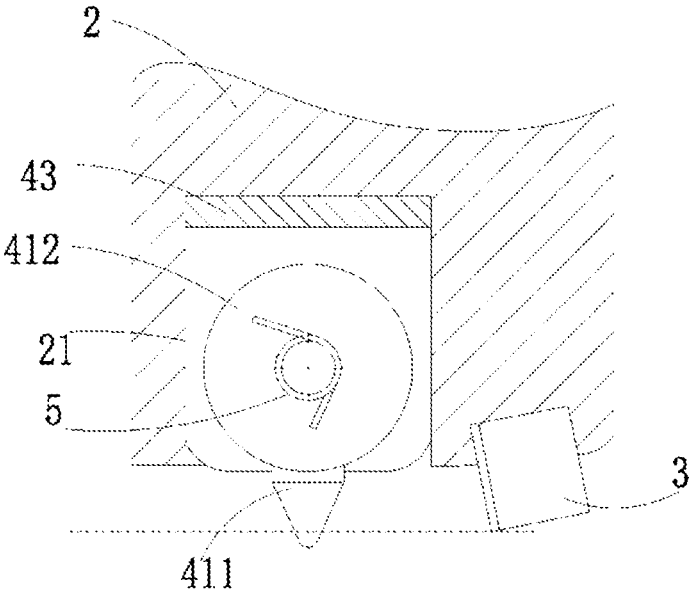
FIG. 15, FIG. 16 and FIG. 17 are schematic structural diagrams of Embodiment 6 of the present invention.
Figure 16:
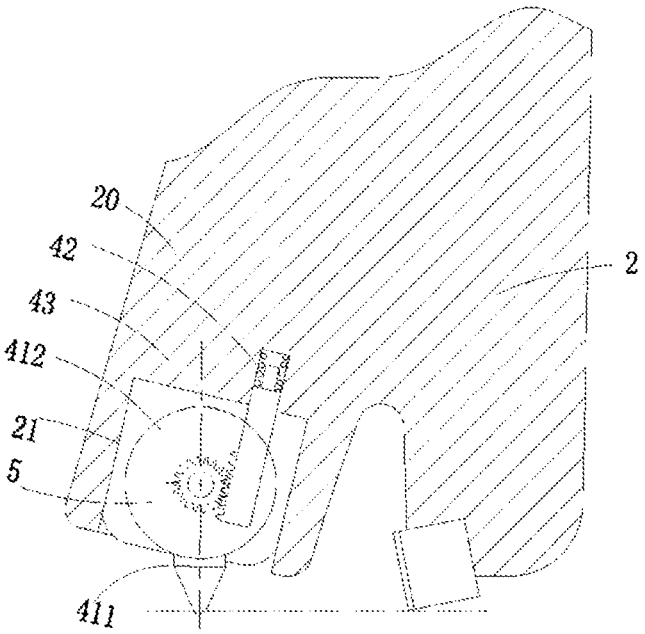
Figure 17:
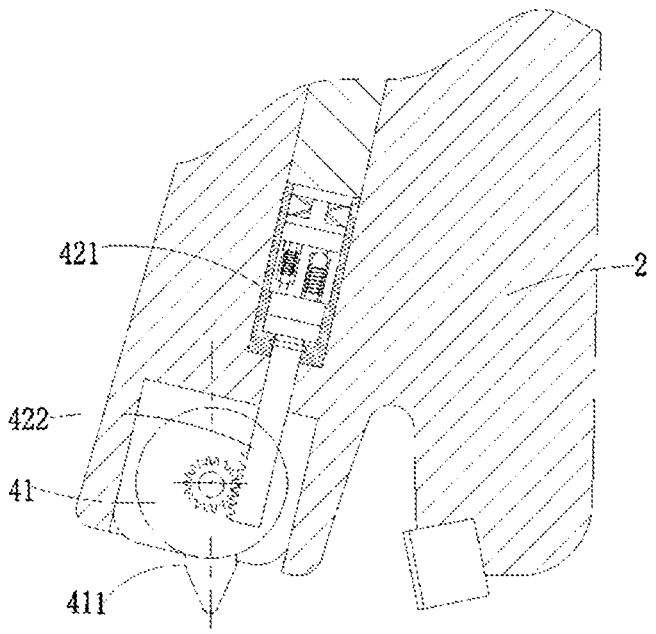

As shown in FIG. 15 to FIG. 18, it is a scheme in which the swing adaptive cushion structure 4 is arranged in front of the cutting teeth 3, wherein, FIG. 15 shows that the cushion structure 4 is directly arranged on the blade 2, and FIG. 16 and FIG. 17 show that a support 20 extends from the front of the blade 2, and the cushion structure 4 is arranged in the support 20.

Figure 19:
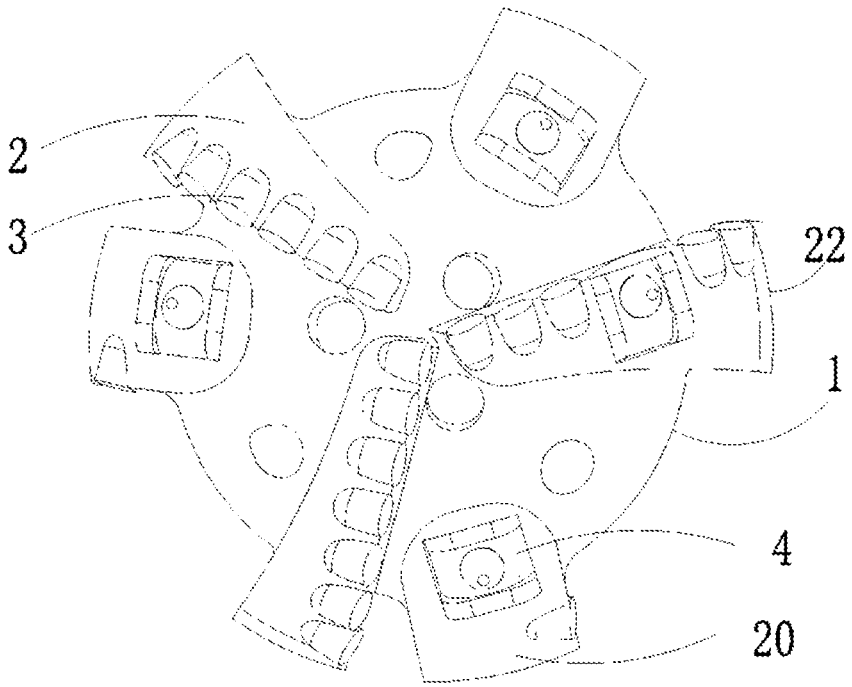
FIG. 19 is a schematic structural diagram of the cushion structure disposed in the independent support of the drill bit body according to Embodiment 6 of the present invention.

Further, as shown in FIG. 19, the support 20 may also be set as an independent support, that is, it is not connected to the blade, and the cushion structure 4 is arranged on the independent support. It is easy to think that the cutting teeth 3 may also be arranged on the independent support 20.

A researcher in the field may easily imagine that the cushion structure 4 may also be arranged side by side with the cutting teeth 3 on the blade 2. Please continue to refer to the arrangement of the cushion structure 4 on the blade 22 in FIG. 19.

Figure 20:
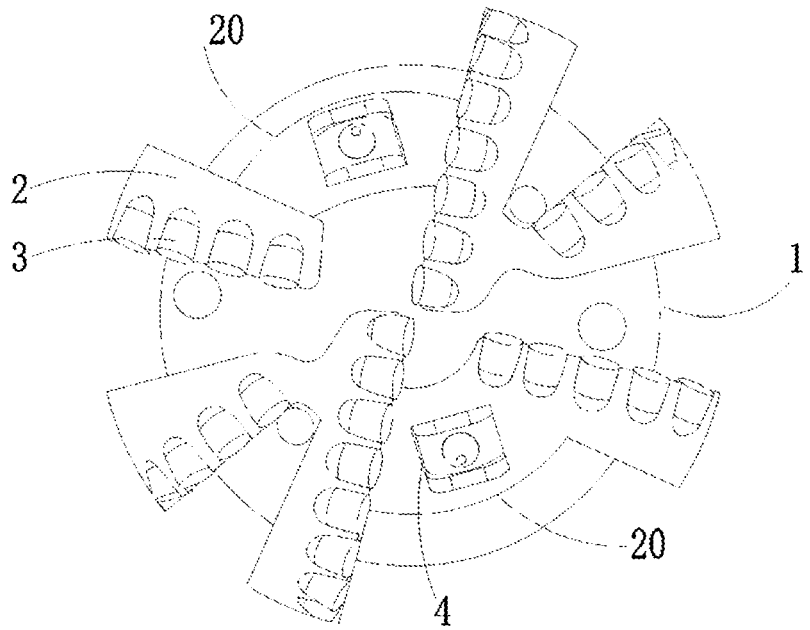
FIG. 20 is a schematic structural diagram of Embodiment 6 of the present invention, wherein the support is connected to two adjacent blades.

Further, a support 20 connecting the front and rear two blades is arranged between the adjacent two blades to form a bridge effect, and a cushion structure 4 is arranged on such a support. This structural scheme may improve the stability of the drill bit, as shown in FIG. 20.

Figure 18:
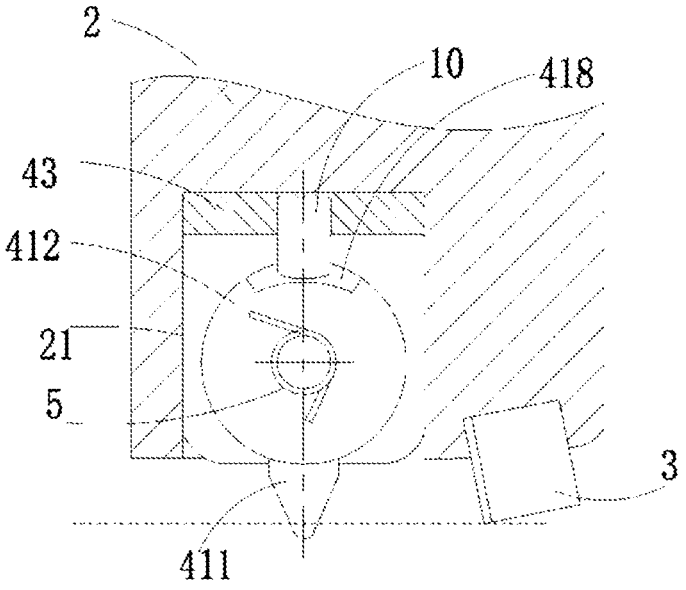
FIG. 18 is a schematic structural diagram of Embodiment 6 of the present invention, wherein a limiting mechanism is provided on the cushion structure.

Further preferably, a limiting mechanism is provided on the cushion structure 4 to prevent over-swing of the swing portion 41. As shown in FIG. 18, the limiting mechanism comprises a limit pin 10 and a limit groove 418 formed on the swing portion 41, and the setting of the limiting mechanism may limit the swinging angle of the swing portion 41 within a certain range.

Referring to FIGS. 16 and 17, motion and force/torque may be transmitted between the reset mechanism 42 and the swing portion 41 through a gear mechanism (comprising a rack and pinion mechanism, a bevel gear mechanism, etc.), a coupling, a chain drive and other transmission mechanisms. Referring to FIG. 17, the reset mechanism 42 is a hydraulic reset mechanism 421, and the motion is transmitted to the swing portion 41 through the transmission device 422, thereby realizing the cushioning and reset of the cushion structure. It may be seen from these two solutions that the swing portion 41 (cushioning portion), the transmission device 422 and the reset mechanism 42 may be respectively or belong to different structural parts, and the beneficial effect is that the design space is larger, and the three mechanisms allow on different components.

Embodiment 7

The present embodiment is basically the same as Embodiments 1 to 6, and the main difference is that the cushioning portion 411 is a rotatable rolling structure.

Figure 21:
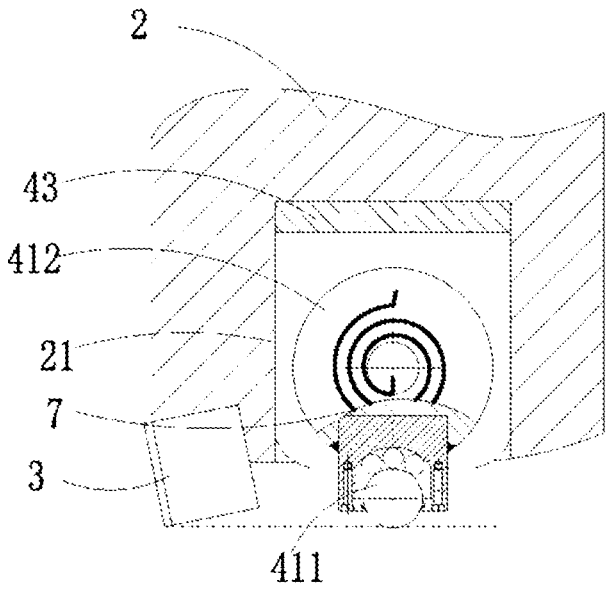
FIG. 21 is a schematic structural diagram of Embodiment 7 of the present invention, wherein the cushioning portion is a rolling structure.

As shown in FIG. 21, the cushioning portion 411 is a rolling ball, and may also be a needle roller. When the cushioning portion 411 has a rolling structure, the working surfaces of the rolling elements are in contact with the bottom hole rock in turn, and the wear rate is slower, which is beneficial to prolong the working life of the cushioning portion.

Embodiment 8

Figure 22:
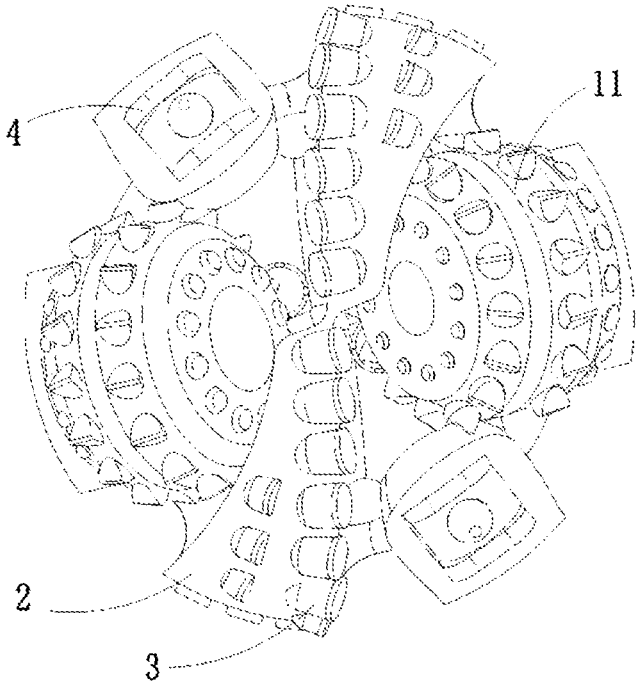
FIG. 22 is a schematic structural diagram of Embodiment 8 of the present invention.

As shown in FIG. 22, in the present embodiment, the cushion structure 4 is applied to a roller cone-PDC composite drill bit. The cushion structure 4 may also be provided on an impregnated diamond drill bit, a TSP drill bit, a cross scraping PDC drill bit, and an impact-scraping PDC drill bit.

Embodiment 9

Figure 23:
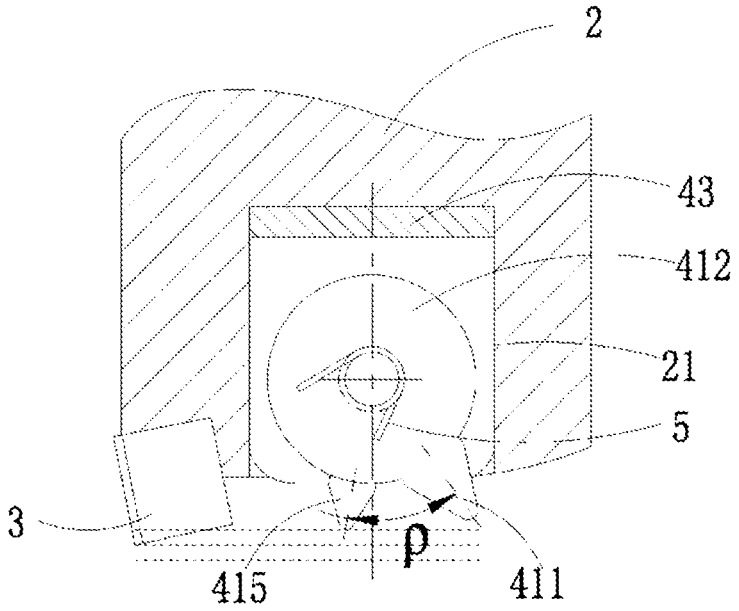
FIG. 23 is a schematic structural diagram of Embodiment 9 of the present invention, wherein the cushion structure is provided with a secondary cushioning portion.

The present embodiment is basically the same as Embodiments 1 to 8, and the main difference is that the cushion structure 4 is further provided with a secondary cushioning portion 415. The setting of the secondary cushioning portion 415 and the primary cushioning portion 411 forms a phase angle ρ. When the primary cushioning portion 411 reaches the lowest position, the secondary cushioning portion 415 is in a working state to avoid excessive cutting depth of the cutting teeth 3, as shown in the FIG. 23.

Figure 24:
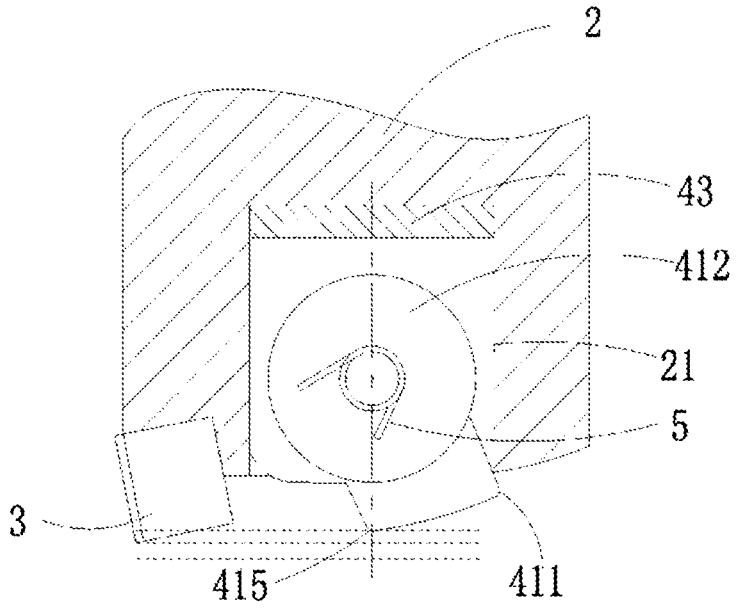
FIG. 24 is a schematic structural diagram of Embodiment 9 of the present invention, wherein the cushion structure is provided with a secondary cushioning portion, wherein the secondary cushioning portion and the primary cushioning portion are integral structures.

It is easy to think that the secondary cushioning portion 415 and the primary cushioning portion 411 are of a one-piece structure, as shown in FIG. 24. When the primary cushioning portion 411 is in its working position, it is mainly used to absorb the impact load. When the primary cushioning portion 411 gives way, the secondary cushioning portion 415 enters the working position (i.e., the current view) to avoid the overcut of the cutting teeth 3.

Embodiment 10

The present embodiment is basically the same as Embodiments 1 to 9. The main difference is that the swing direction 51 of the cushion structure 4 and the cutting direction 31 of the cutting teeth 3 have a certain included angle α in the opposite direction, and the range of the included angle is: $-90° \leq \alpha \leq 90°$.

Figure 25:
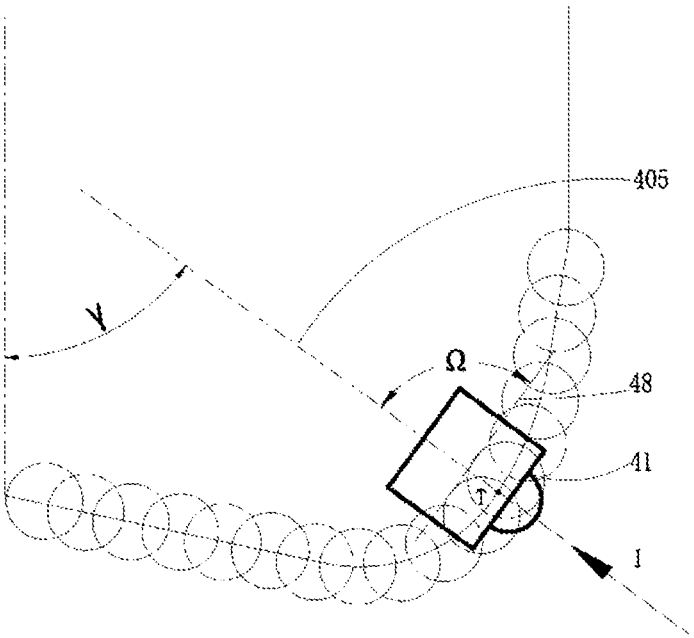
Figure 26:
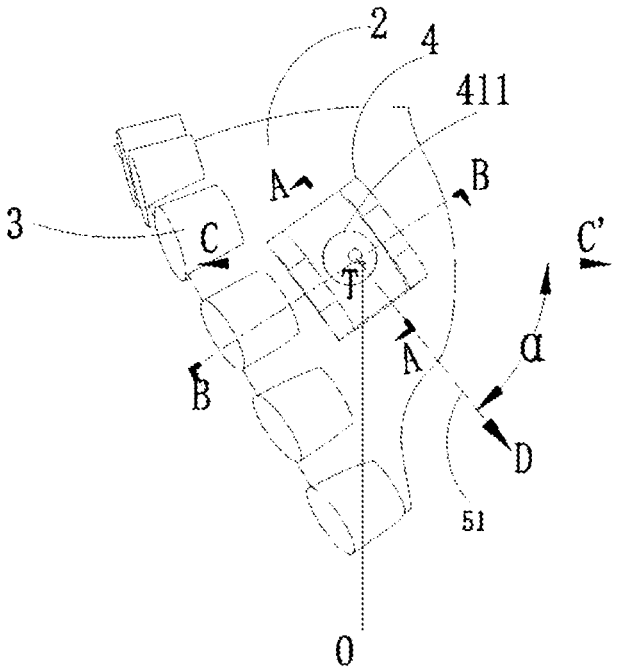
FIG. 26 and FIG. 27 are the I perspectives of the covered drawings of the teeth.

The setting of the included angle a may reduce the installation accuracy of the swing portion 41 and improve the design efficiency, as shown in FIG. 25 and FIG. 26. In the positive angle range, when the included angle α is 0°, the swing direction of the cushion structure is the same as the reverse direction of the cutting teeth, and the cushioning portion of the cushion structure contacts the rock and has the fastest swing speed. When the included angle α is 90° (that is, the side perpendicular to the cutting direction), the swing direction of the cushion structure is the radial direction. Although the cushioning portion is in contact with the rock and is stressed, the swing direction of the cushion structure is inconsistent with the force direction, and the swing speed is slow and the structure even cannot rotate. Obviously, when the included angle α increases in the range of 0° to 90°, the swing speed becomes slower and slower, and when it is impacted, the slower the swing speed, the stronger the vibration absorption ability. The same is true in the negative angle range, which will not be repeated here.

FIG. 25 is a drawing of the covered teeth of the drill bit, wherein 405 is the normal line of the cushion structure 41, the included angle γ between the normal line and the center line of the drill bit is the normal angle, and Ω is the included angle between the normal line 405 and the rotating portion (rotating shaft) 48, with the range of $0° < \Omega < 180°$.

Figure 27:
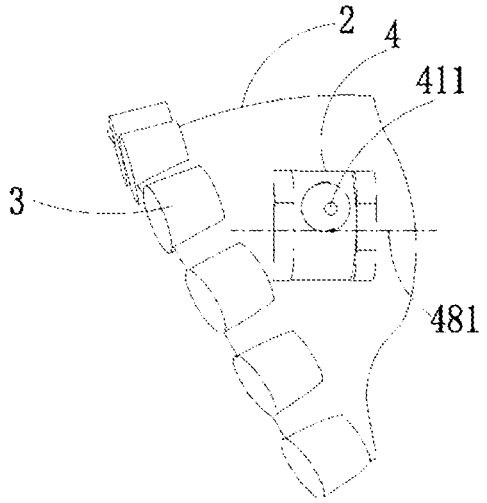
Figure 28:
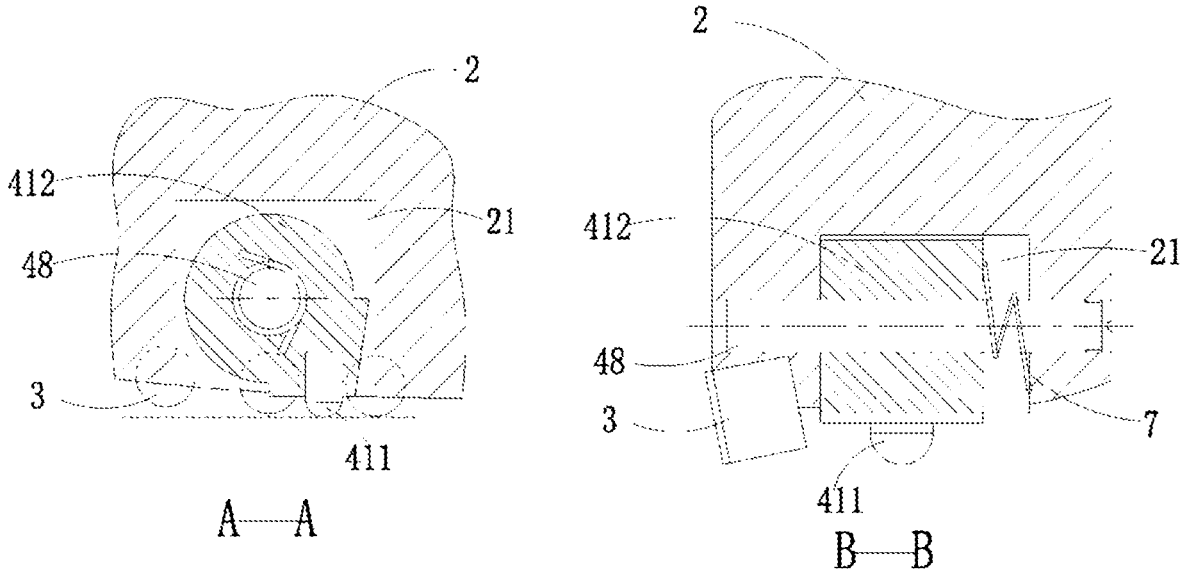
FIG. 28 is a partial cross-sectional view of FIG. 27.
Figure 29:
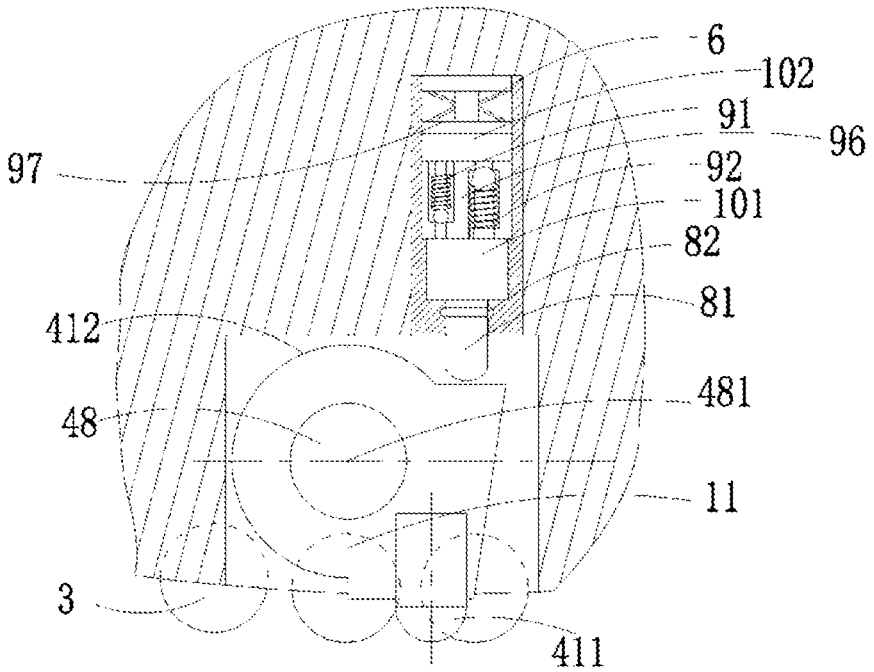
FIG. 29 is a schematic structural diagram of Embodiment 10 of the present invention, wherein the reset mechanism is a hydraulic spring.
Figure 30:
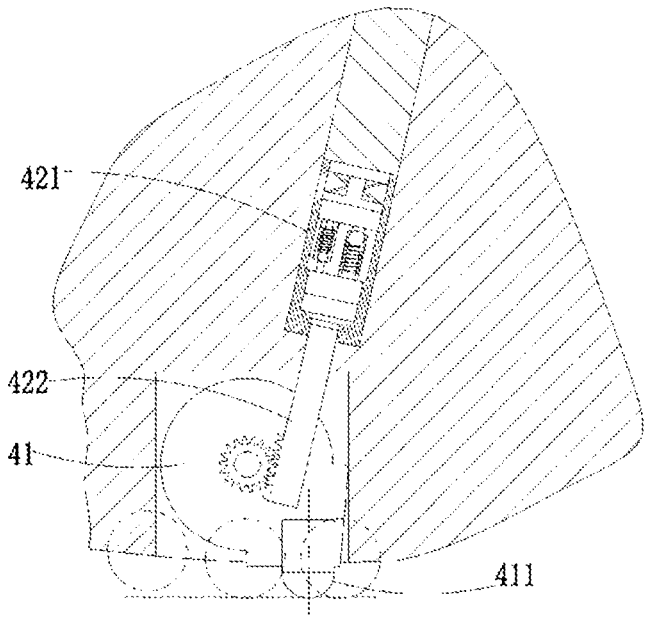
FIG. 30 is a schematic structural diagram of Embodiment 10 of the present invention, wherein a transmission mechanism is provided between the rotating portion and the reset mechanism.

Further preferably, the cushioning portion 411 on the cushion structure 4 is eccentrically arranged, and under the action of the normal force of the bottom hole rock, the cushioning portion 411 swings on the offset side, as shown in FIGS. 27 and 28, wherein FIG. 28 is a partial cross-sectional view of FIG. 27. The cushioning portion 411 is offset relative to the bottom hole normal line passing through the swing center, and the offset is large. Therefore, when the cushioning portion 411 touches the bottom hole, the force from the bottom hole rock has both normal force and tangential force. No matter which direction the cushion structure 4 is placed in, the normal force will make the cushioning portion 411 swing around its rotation axis (i.e., the rotating portion) on the offset side. The larger the offset, the greater the torque that drives the cushioning portion 411 to swing (because of the longer moment arm of the normal force). Still further preferably, the reset mechanism 42 of the cushion structure 4 is a hydraulic spring, as shown in FIG. 29. Motion and force/torque may be transmitted between the reset mechanism 42 and the swing portion 41 through a gear mechanism (comprising a rack and pinion mechanism, a bevel gear mechanism, etc.), a coupling, a chain drive and other transmission devices 422. FIG. 30 shows that the reset mechanism 42 and the swing portion 41 are connected by a rack and pinion mechanism.

Embodiment 11

Figure 31:
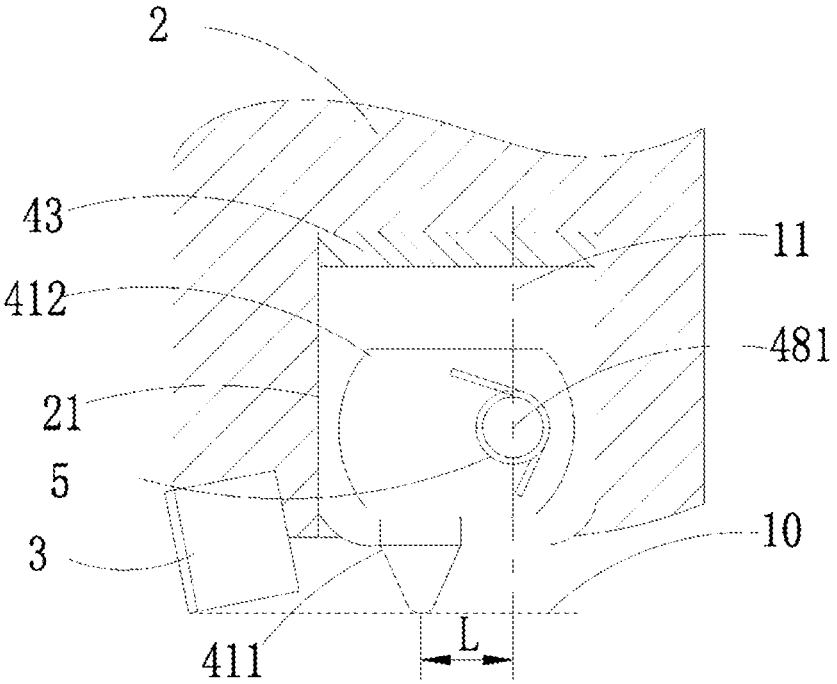
FIG. 31 is a schematic structural diagram of Embodiment 11 of the present invention.

The present embodiment is basically the same as Embodiment 10. The cushioning portion 411 is located in the middle of the axis 481 of the swing shaft and the cutting teeth 3. The characteristic of the present embodiment is that the cushioning portion 411 is closer to the cutting teeth 3, which is easy to achieve better cushioning, as shown in FIG. 31. A more optimal solution is that the distance L between the contact point of the cushioning portion and the rock and the bottom hole normal of the swing shaft 481 over the cushion structure is in the range: $d \leq L \leq 10d$, where d is the diameter of the cutting teeth on the drill bit. When L is large enough, the normal force may provide a large moment to make the cushion step 411 rotate about the swing axis 481, actually giving way relative to the drill bit body.

The embodiments of the present disclosure described above and illustrated in the accompanying drawings do not limit the scope of the present disclosure, which is to be covered by the scope of the appended claims and their legal equivalents. Any equivalent embodiments are within the scope of this disclosure. Indeed, various modifications of the present disclosure, in addition to those shown and described herein, such as alternative useful combinations of the elements, will be apparent to those skilled in the art from the foregoing description. Such modifications and embodiments are within the scope of the appended claims and equivalents.

The invention claimed is:

1. A PDC drill bit, comprising:

a drill bit body (1) and a blade (2) extending from the drill bit body (1), the blade (2) being provided with cutting teeth (3), a cushion structure (4) received in a base hole (21) in the drill bit, and a reset mechanism (42) disposed in the base hole and in contact with the cushion structure, wherein the reset mechanism comprises a hydraulic device (421) or is selected from a torsion spring (5), a coil spring (7), and a leaf spring (401), wherein the cushion structure has a swing portion (41) connected to a cushioning portion (411), wherein the swing portion is a runner or a rod that is received in the base hole and affixed thereto through a rotating shaft (48), at least a portion of the cushioning portion extends out from the base hole and is configured to swing about an opening of base hole, and wherein, during operation, the cushioning portion engages a formation, moving from an initial position when subjected to a torque force from the formation and returning to the initial position driven by the reset mechanism when the reset mechanism overcomes the torque force, and a distance L between a contact point of the cushioning portion on the formation and a bottom hole normal of the shaft of the cushion structure is in the range: $d \leq L \leq 10d$, d being a diameter of the cutting teeth on the drill bit.

2. The PDC drill bit according to claim 1, wherein the cushioning structure (4) is arranged on the blade (2) and is rotatably connected to the blade (2).

3. The PDC drill bit according to claim 1, wherein when the cushion structure (4) is in the initial position, the cushion structure (4) is in a high contact with a bottom hole rock surface in the formation, wherein a height difference D between a highest point of the cushion structure (4) for contacting a bottom hole rock surface and a highest point of the cutting tooth (3) edge is less than a diameter of the cutting teeth (3).

4. The PDC drill bit according to claim 1, wherein the cushion structure (4) is arranged in front of or behind the cutting teeth (3), relative to a cutting direction of the PDC drill bit, or the cushion structure (4) is arranged on an independent support (20) of the blade (2) or the drill bit body (1).

5. The PDC drill bit according to claim 4, wherein the cushion structure (4) is arranged behind the cutting teeth (3) on the blade (2), and the cushion structure (4) has a certain included angle between a swing direction of the cushion structure and a direction opposite to the cutting direction of the PDC drill bit, and the included angle ranges from −90° to 90°.

6. The PDC drill bit according to claim 1, wherein the swing portion (41) is connected to the reset mechanism (42) arranged in the base hole (21).

7. The PDC drill bit according to claim 6, wherein the cushioning portion (411) is an insert structure inlaid and fixed on the swing portion (41), or the cushioning portion (411) is a rolling structure that is freely rotatably connected to the swing portion (41), or the cushioning portion (411) and the swinging portion (41) form a single structure.

8. The PDC drill bit according to claim 1, comprising a plurality of blades (2), a plurality of cushion structures (4), and a plurality of base holes (21).

9. The PDC drill bit according to claim 1, wherein the reset mechanism comprises the hydraulic device.

10. The PDC drill bit according to claim 1, wherein, at the initial portion, a center line of the cushioning portion extending through the shaft is perpendicular to a bottom of the base hole.

11. A PDC drill bit, comprising:

a drill bit body and a blade extending from the drill bit body, the blade being provided with cutting teeth, a cushion structure received in a base hole in the drill bit, and a reset mechanism disposed in the base hole and in contact with the cushion structure, wherein the reset mechanism comprises a hydraulic device, wherein the cushion structure comprises two cushioning portions that are two cushioning teeth and a swing portion connected to the two cushioning portions, wherein the swing portion is a runner or a rod that is received in the base hole and affixed thereto through a rotating shaft, at least a portion of the cushioning portion extends out from the base hole and is configured to swing about an opening of base hole, and wherein, during operation, the cushioning portion engages a formation, moving from an initial position when subjected to a torque force from the formation and returning to the initial position driven by the reset mechanism when the reset mechanism overcomes the torque force, wherein the swing portion is connected to the reset mechanism arranged in the base hole.

12. A PDC drill bit according to claim 1, comprising:

a drill bit body and a blade extending from the drill bit body, the blade being provided with cutting teeth, a cushion structure received in a base hole in the drill bit, and a reset mechanism disposed in the base hole and in contact with the cushion structure, wherein the reset mechanism comprises a hydraulic device, wherein the cushion structure has a swing portion connected to a cushioning portion, wherein the swing portion is a runner or a rod that is received in the base hole and affixed thereto through a rotating shaft, at least a portion of the cushioning portion extends out from the base hole and is configured to swing about an opening of base hole, and wherein, during operation, the cushioning portion engages a formation, moving from an initial position when subjected to a torque force from the formation and returning to the initial position driven by the reset mechanism when the reset mechanism overcomes the torque force, wherein the reset mechanism further comprises a disc spring in contact with the hydraulic device.

* * * * *